US006034579A

United States Patent [19]

Tada et al.

[11] Patent Number: 6,034,579

[45] Date of Patent: Mar. 7, 2000

[54] DIELECTRIC FILTER OF THE BAND ELIMINATION TYPE

[75] Inventors: Hitoshi Tada, Ishikawa-gun; Tatsuya Tsujiguchi, Kanazawa, both of Japan

[73] Assignee: Murata Manufacturing Co., Ltd., Japan

[21] Appl. No.: 08/390,629

[22] Filed: Feb. 17, 1995

[30] Foreign Application Priority Data

Feb. 18, 1994 [JP] Japan ..... 6-021342

[51] Int. Cl.[7] ..... H01P 1/205

[52] U.S. Cl. ..... 333/202; 333/206; 333/207; 333/222; 333/223

[58] Field of Search ..... 333/202, 206, 333/207, 222, 223

[56] References Cited

U.S. PATENT DOCUMENTS 5,614,875 3/1997 Jang et al. ..... 333/202

FOREIGN PATENT DOCUMENTS 4051602 2/1992 Japan ..... 333/206
4051603 2/1992 Japan ..... 333/206
4056501 2/1992 Japan ..... 333/202 DB
4095401 3/1992 Japan ..... 333/202 DB

*Primary Examiner*—Benny Lee
*Attorney, Agent, or Firm*—Ostrolenk, Faber, Gerb & Soffen, LLP

[57] ABSTRACT

A dielectric filter is formed by a plurality of resonator holes which are formed in a single dielectric block in such a manner that they extend in a direction between an open-circuited end surface and a short-circuited end surface of the dielectric block. The resonator holes are opened only at the short-circuited end surface. An inner conductor is formed on an inner surface of each of the resonator holes. An outer conductor is formed on an outer surface of the dielectric block. Capacitor electrodes respectively corresponding to the resonator holes are formed on the open-circuited end surface of the dielectric block. Input/output electrodes electrically connected to the capacitor electrodes are formed in such a manner that they extend on both the open-circuited end surface and a bottom surface of the dielectric block. In this structure, since all the capacitive components constituting the filter can be obtained by either the capacitances formed between the capacitor electrodes and the inner conductors, or the capacitances formed in a gap between the capacitor electrodes, the dielectric filter can be constructed in the form of a single block.

26 Claims, 4 Drawing Sheets

DIELECTRIC FILTER OF THE BAND ELIMINATION TYPE

BACKGROUND OF THE INVENTION

1. Field of the Invention

The present invention relates to a dielectric filter for use in mobile communication apparatus, such as automobile telephone sets and portable telephone sets.

2. Description of the Related Art

FIG. 5 shows an equivalent circuit of a conventional band elimination filter, which is constituted by, for example, resonators R1 and R2, trap capacitors Ct and a coupling capacitor Ce. Such a conventional dielectric filter may have the configuration shown in FIG. 4. In FIG. 4, two block-shaped dielectric resonators 1 and a capacitor substrate 11 with capacitor electrodes formed on two surfaces thereof are mounted on a base plate 10. Input/output electrodes and grounding electrodes are formed on two surfaces of the base plate 10. Each of the dielectric resonators has an inner conductor 3 which is electrically connected to the capacitor substrate 11 by a metal connection terminal 20. An outer conductor 4 of each of the dielectric resonators is electrically connected to the grounding electrodes on the substrate 10.

In the above-described conventional dielectric resonator, a single resonator hole 2 is formed in a substantially rectangular parallelepiped-shaped dielectric block 1 in such a manner that it passes through a pair of opposing end surfaces. An inner conductor 3 is formed on the inner peripheral surface of the resonator hole 2, and an outer conductor 4 is formed on five plane surfaces of the block 1 except for a plane 1*a* (hereinafter referred to as an open-circuited end surface) thereof, the plane 1*a* constituting one of the two planes to which the resonator hole 2 is opened. The inner conductor 3 is separated (open-circuited) from the outer conductor 4 at the open-circuited end surface 1*a*, and is electrically connected (short-circuited) to the outer conductor 4 at a plane 1*b* (hereinafter referred to as a short-circuited end surface) of the block 1 which constitutes the other of the two planes to which the resonator hole 2 is opened.

The trap capacitors Ct shown in FIG. 5 are formed by capacitances between the capacitor electrodes formed on the upper and lower surfaces of the capacitor substrate 11, and the coupling capacitor Ce is obtained by the capacitance formed in a gap between the capacitor electrodes on the lower surface of the capacitor substrate 11.

These conventional dielectric filters require many parts, including a plurality of dielectric resonators, a capacitor substrate used to obtain the capacitance constituting a filter circuit, a base plate on which various electrodes are formed and on which the dielectric resonators, the capacitor substrate and so on are mounted, connection terminals for connecting the dielectric resonators to the capacitor substrate and so on. Further, these parts must be soldered for assembly. Thus, a reduction in the size of the entire filter is difficult to obtain, the cost of parts is increased, and the number of manhours required for the manufacturing process and hence the production cost are high.

SUMMARY OF THE INVENTION

Accordingly, an object of the present invention is to provide an inexpensive and small dielectric filter which enables the problems suffered by the above conventional dielectric filter to be overcome, by reducing the number of parts and hence the number of manhours required for the manufacturing process.

To achieve the aforementioned object, the present invention may provide a dielectric filter which comprises a dielectric block having a plurality of resonator holes which extend between a pair of end surfaces of the dielectric block, each of the resonator holes having an opening which is opened to only one of the end surfaces of the dielectric block, an inner conductor formed on an inner surface of each of the resonator holes, an outer conductor formed on an outer surface of the dielectric block, capacitor electrodes respectively corresponding to the resonator holes, the capacitor electrodes being formed on the other end surface which opposes the end surface to which the resonator holes are opened, and input/output electrodes formed on the outer surface of the dielectric block, the input/output electrodes being electrically connected to the capacitor electrodes corresponding to two resonator holes which serve as input/output stages.

In this structure, since each of the capacitive components constituting the filter can be obtained by either the capacitances formed between the capacitor electrodes and the inner conductors, or the capacitances formed in a gap between the capacitor electrodes, the dielectric filter can be constructed in the form of a single block without using externally mounted capacitor elements and other parts for providing connections.

Other features and advantages of the invention will be apparent from the following description of embodiments thereof, taken in connection with the accompanying drawings.

BRIEF DESCRIPTION OF THE DRAWINGS

FIG. 1(*b*) is a perspective view of the dielectric filter shown in FIG. 1(*a*), as viewed when looking from the direction of a short-circuited end surface of the filter;

FIG. 3(*b*) illustrates an equivalent circuit of the dielectric filter of FIG. 3(*a*);

DESCRIPTION OF PREFERRED EMBODIMENTS

Figure 1A:
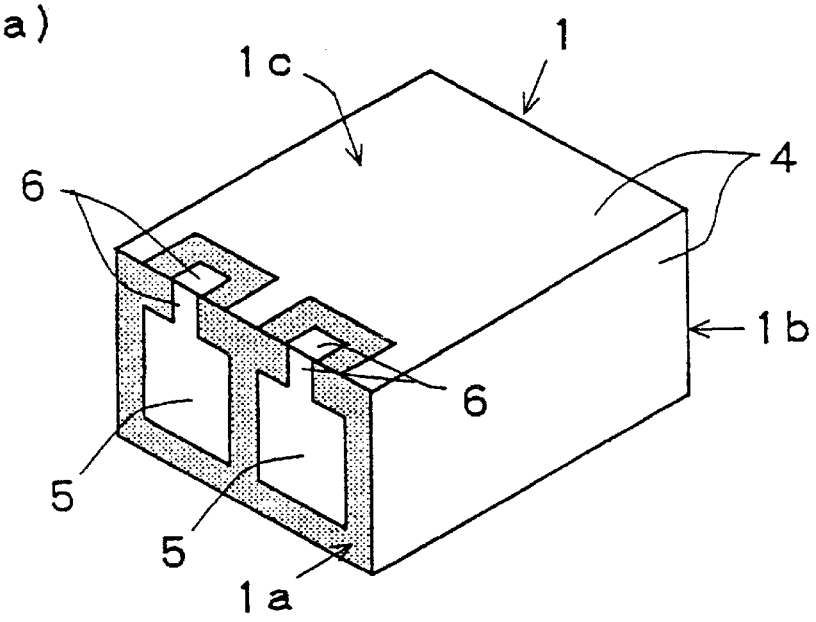
FIG. 1(*a*) is a perspective view of a first embodiment of a dielectric filter according to the present invention, as viewed when looking from the direction of an open-circuited end surface of the filter.

Embodiments of the present invention will now be described with reference to the accompanying drawings. Reference numerals in these figures identical to those in the conventional filter represent similar or identical elements and may not all be described in connection with all figures. The shaded portions in the figures indicate portions of the filter in which the material of a dielectric block or substrate is exposed (a portion with no conductor formed thereon).

A first embodiment of the present invention will be described with reference to FIGS. 1(*a*), 1(*b*) and 2.

The dielectric filter of this embodiment has a substantially rectangular parallelepiped-shaped dielectric block 1. Two resonator holes 2 (see FIGS. 1(*b*) and 2) are formed in the dielectric block 1 in such a manner that they extend between the pair of opposing end surfaces 1*a* and 1*b*. An inner conductor 3 (see FIGS. 1(*b*) and 2) is formed on the inner surface of each of the resonator holes 2. Capacitor electrodes 5 (see FIGS. 1(*a*) and 2) respectively corresponding to the resonator holes 2 are formed on the open-circuited end surface 1*a* of the dielectric block 1. Input/output electrodes 6 (see FIGS. 1(*a*) and 1(*b*) respectively connecting to the capacitor electrodes 5 are formed on both the open-circuited end surface 1*a* and a bottom surface 1*c*, which is the upper surface as viewed in FIGS. 1(*a*) and 1(*b*) and which serves as a mounting surface. An outer conductor 4 is formed on the entire outer surface of the dielectric block 1 with the exception of the open-circuited end surface 1*a* and a portion of the bottom surface 1*c* on which the input/output electrodes 5 are formed.

Figure 2:
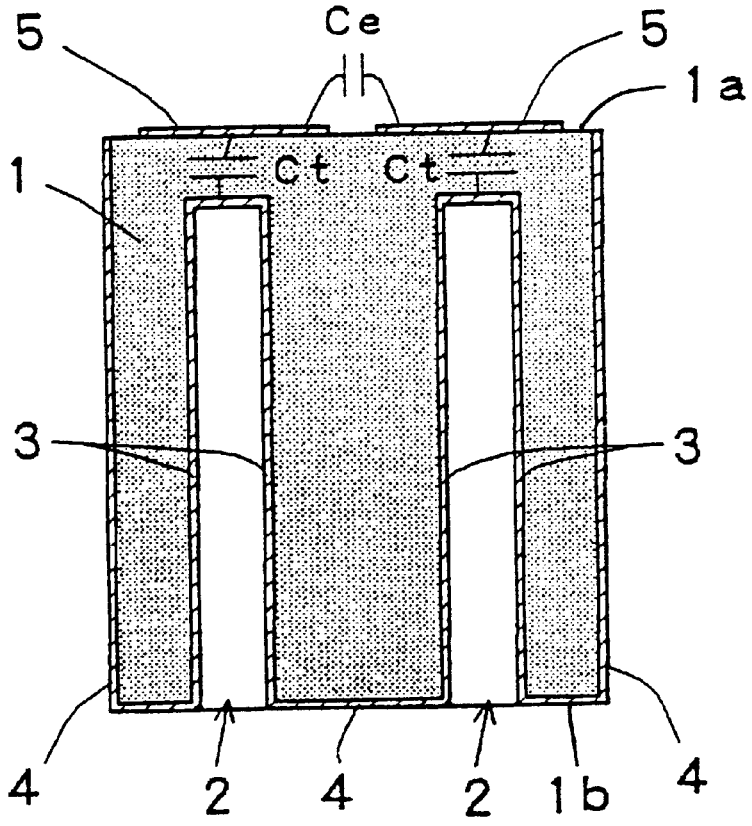
FIG. 2 is a cross-sectional view taken along the central horizontal plane of the dielectric filter shown in FIG. 1.

As shown in FIG. 2, each of the resonator holes 2 is formed in such a manner that it extends from the short-circuited end surface 1*b* to the vicinity of the open circuited end surface 1*a*. That is, each of the resonator holes 2 is a blind hole which is open only at the short-circuited end surface 1*b*.

Each of the inner conductors 3 is electrically connected (short-circuited) to the outer conductor 4 at the short-circuited end surface lb at which the resonator hole 2 is opened.

Figure 1B:
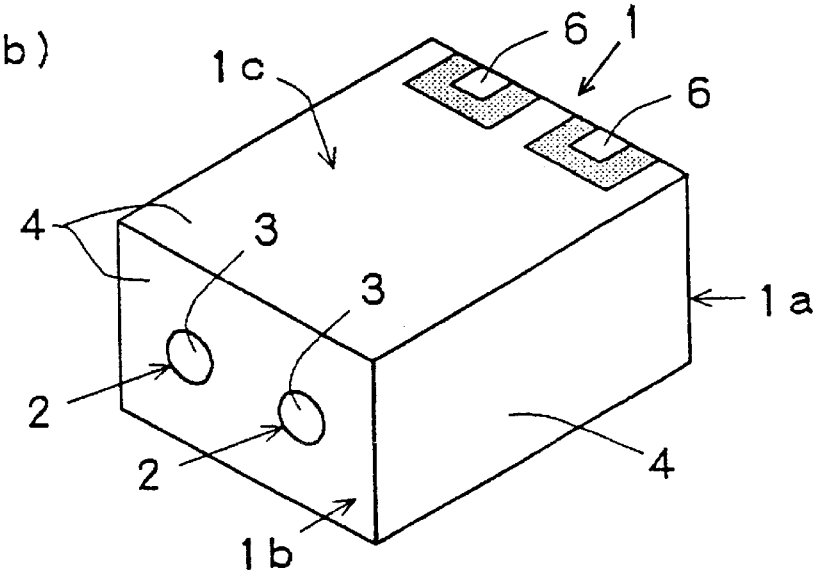
Figure 5:
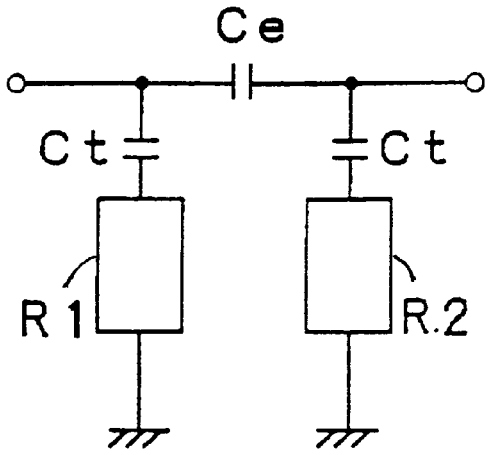
FIG. 5 PRIOR ART
FIG. 5 illustrates an equivalent circuit of the band elimination filter of FIG. 4.

The dielectric filter arranged in the manner shown in FIGS. 1(*a*), 1(*b*) and 2 constitutes a band elimination filter having two resonators, the equivalent circuit of which is the same as that shown in FIG. 5. That is, the resonators formed in the resonator holes 2 in this embodiment correspond to the resonators R1 and R2 shown in FIG. 5. The capacitances formed between the capacitor electrodes 5 and the inner conductors 3, shown in FIG. 2, correspond to the trap capacitors Ct, and the capacitance formed in the gap between the capacitance electrodes 5 forms the coupling capacitor Ce.

The above-described dielectric filter is mounted on a substrate with the bottom surface (which is the upper surface as viewed in FIG. 1(*a*)), having portions of the input/output electrodes 5 formed thereon, facing the substrate.

A second embodiment of the present invention will be described below with reference to FIGS. 3(*a*) and 3(*b*). In this embodiment, the dielectric filter includes three resonators formed respectively in three resonator holes in the dielectric block. In this embodiment, the two input/output electrodes 6 are respectively electrically connected to side capacitor electrodes 5*a*, corresponding to the resonator holes located on the two sides of the block, which serve as input and output stages. However, there is no input/output electrode corresponding to the center resonator hole and center capacitor electrode 5*b* located at the center of the block, as shown in FIG. 3(*a*).

Each of the resonator holes is a blind hole having a bottom near the open-circuited end surface 1*a*. This and all other structure of this embodiment is the same as that of the first embodiment shown in FIGS. 1(*a*), 1(*b*) and 2, description thereof being omitted.

Figure 3A:
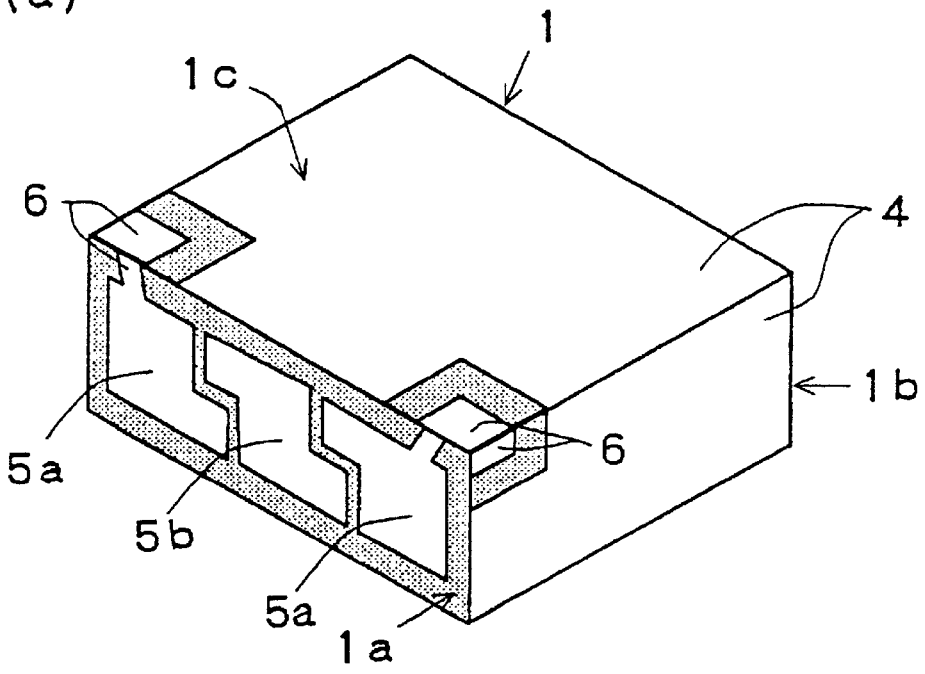
FIG. 3(*a*) is a perspective view of a second embodiment of a dielectric filter according to the present invention, as viewed when looking from the direction of an open-circuited end surface of the filter.
Figure 3B:
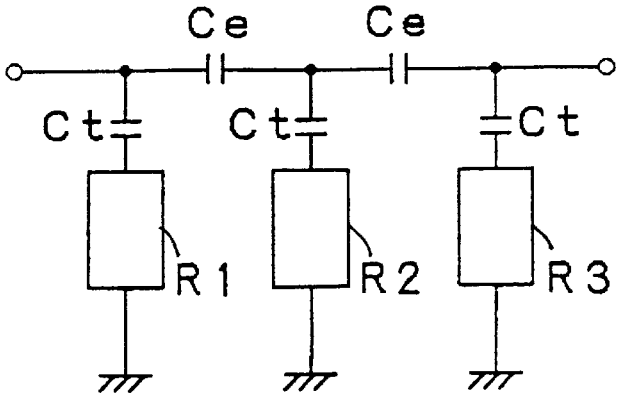
Figure 4:
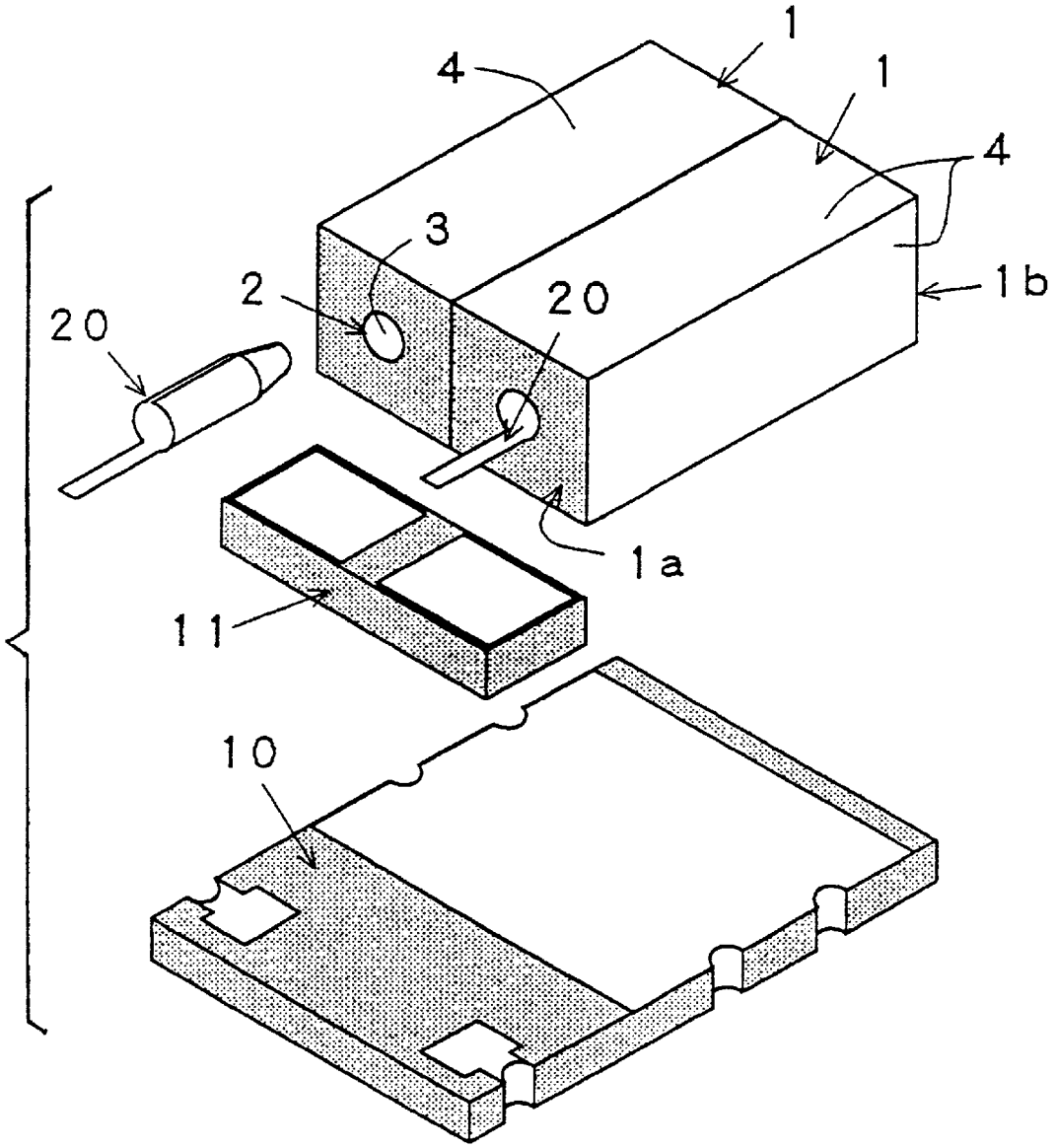
FIG. 4 PRIOR ART
FIG. 4 is a perspective view of a conventional dielectric filter which employs dielectric resonators and which acts as a band elimination filter.

The dielectric filter arranged in the manner described above constitutes a band elimination filter having three resonator stages R1, R2 and R3, the equivalent circuit of which is shown in FIG. 3(*b*). That is, the capacitances formed between the capacitor electrodes 5*a*, 5*b* and the inner conductors 3 form the trap capacitors Ct shown in FIG. 3(*b*), and the capacitances formed in the gaps between the capacitor electrodes 5*a*, 5*b* constitute the coupling capacitors Ce shown in FIG. 3(*b*).

As mentioned above, the dielectric filters of the above-described embodiments are characterized in that a plurality of resonators are formed in a single dielectric block and in that the capacitive components and input/output portions, constituting the filter, are formed completely by various electrodes and conductors formed on the dielectric block. Thus, the dielectric filter of the above-described embodiments does not require a plurality of dielectric resonators, connection terminals, externally mounted capacitor elements and so on, which would be necessary in a conventional dielectric filter, and hence does not require a substrate on which these elements and dielectric resonators are mounted.

The value of the trap capacitor Ct can be adjusted by changing the area of the capacitor electrode or the distance between the capacitor electrode and the inner conductor. The value of the coupling capacitor Ce can be adjusted by changing the width or length of the gap between the adjoining capacitor electrodes. One method of increasing the capacitance, as shown in FIG. 3(*a*), may be to increase the lengths of the adjoining sides of the capacitor electrodes by changing the shape of each capacitor electrode, for example by forming the sides of the capacitor electrodes with a zig-zag shape.

Thus, there is no limitation on the shapes and dimensions of the capacitor electrodes and any desired shapes or dimensions can be set, corresponding to desired electrical characteristics.

The input/output electrodes are not limited to having the shapes and positions shown in FIG. 3(*a*). For example, the input/output electrode may also be formed in such a manner that it extends over the open-circuited end surface, the bottom surface and/or the side surface of the dielectric resonator serving as the input or output stage.

While the preferred embodiments of the invention have been shown as two- and three-stage dielectric filters, other embodiments of the invention may include a dielectric filter having four or more stages.

It is further understood by those skilled in the art that the foregoing description merely describes preferred embodiments of the present invention and that various changes and modifications may be made without departing from the spirit and scope of the invention.

As will be understood from the foregoing description, in the dielectric filter according to the present invention, a plurality of resonators are formed in a single dielectric block, and capacitive components and input/output portions, constituting the filter, are provided by various electrodes and conductors formed exclusively on the dielectric block. It is thus possible to provide a dielectric filter without employing a plurality of dielectric resonators, connection terminals, externally mounted capacitor elements, a substrate on which these parts are mounted, and so on.

Accordingly, the number of parts can be greatly reduced, greatly reducing the cost of parts and hence the production cost. Consequently, an inexpensive and small dielectric filter can be provided.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of manufacturing a dielectric filter comprising the steps of:

forming a dielectric block having an outer surface including opposed first and second end surfaces, and a plurality of resonator holes which extend in a direction defined between said first and second end surfaces;

forming a respective opening at each of said resonator holes at a first end thereof which opens at said first end surface of said dielectric block, and each said hole having a respective second end disposed within said dielectric block;

forming a respective inner conductor on an inner surface of each of said resonator holes;

forming a plurality of capacitor electrodes respectively corresponding to said resonator holes, said capacitor electrodes being disposed on said second end surface, each capacitor electrode being spaced from said second end of the corresponding resonator hole so as to define a respective first capacitance with the corresponding inner conductor of said hole;

said respective capacitor electrodes further being spaced from each other along said second end surface so as to define between each adjacent pair of capacitor electrodes a corresponding second capacitance;

forming a pair of input/output electrodes at least on said second end surface of said dielectric block, said pair of input/output electrodes being electrically connected to corresponding ones of said capacitor electrodes; and forming an outer conductor on said outer surface of said dielectric block except for a portion of said outer surface surrounding said capacitor electrodes and input/output electrodes;

further comprising the step of adjusting a gap between two of said capacitor electrodes so as to obtain a predetermined second capacitance therebetween.

2. A method as in claim 1, wherein said adjusting step comprises the step of adjusting a shape of at least one of said capacitor electrodes so as to adjust said gap.

3. A method as in claim 1, wherein said adjusting step comprises the step of adjusting a width of the gap defined between said two capacitor electrodes.

4. A method as in claim 3, wherein a respective shape of at least one of said capacitor electrodes is adjusted so as to adjust said gap width.

5. A method as in claim 1, wherein said step of forming the dielectric block further comprises the steps of forming opposed first and second side surfaces which extend between said end surfaces, and opposed top and bottom surfaces which extend between said first and second end surfaces, and which also extend between said first and second side surfaces, and wherein said step adjusting a gap comprises the step of adjusting a length of the gap, said length being defined by a direction extending generally between said top and bottom surfaces.

6. A method as in claim 5, wherein a respective shape of at least one of said capacitor electrodes is adjusted so as to adjust said gap length.

7. A dielectric band-elimination filter comprising:

a dielectric block having an outer surface including opposed first and second end surfaces, and a plurality of resonator holes which extend in a direction defined between said first and second end surfaces;

each said resonator hole having a respective opening at a first end thereof which opens at said first end surface of said dielectric block, and each said hole having a respective second end disposed within said dielectric block;

a respective inner conductor disposed on an inner surface of each of said resonator holes;

a plurality of capacitor electrodes respectively corresponding to said resonator holes, each said capacitor electrode being disposed on said second end surface and spaced from said second end of the corresponding resonator hole so as to define a respective first capacitance with the corresponding inner conductor of said hole;

said respective capacitor electrodes further being spaced from each other along said second end surface so as to define between each adjacent pair of capacitor electrodes a corresponding second capacitance; and an outer conductor disposed on said outer surface of said dielectric block except for a portion of said outer surface surrounding said capacitor electrodes, said outer conductor being conductively connected at said first end surface to each of said inner conductors;

wherein said inner conductors and said capacitor electrodes are configured and disposed so that said dielectric block, inner and outer conductors, and capacitor electrodes provide a band-elimination filter.

8. A dielectric filter as in claim 7, wherein said plurality of resonator holes comprises two said resonator holes and said plurality of capacitor electrodes comprises two said respective capacitor electrodes which define therebetween one said corresponding second capacitance.

9. A dielectric filter as in claim 8, further comprising a pair of input/output electrodes disposed at least on said second end surface of said dielectric block, each of said input/output electrodes being electrically connected to a corresponding one of said capacitor electrodes; wherein said respective capacitor electrodes are capacitively coupled in series between said input/output electrodes by said respective second capacitances formed between each adjacent pair of capacitor electrodes, and said first capacitances define respective capacitive couplings between said corresponding capacitor electrodes and inner conductors.

10. A dielectric filter as in claim 7, wherein said plurality of resonator holes comprises three said resonator holes and said plurality of capacitor electrodes comprises three said respective capacitor electrodes, each adjacent pair of said respective capacitor electrodes defining therebetween a corresponding said second capacitance.

11. A dielectric filter as in claim 10, further comprising a pair of input/output electrodes disposed at least on said second end surface of said dielectric block, each of said input/output electrodes being electrically connected to a corresponding one of said capacitor electrodes; wherein said respective capacitor electrodes are capacitively coupled in series between said input/output electrodes by said corresponding second capacitances formed between each adjacent pair of capacitor electrodes, and said first capacitances define respective capacitive couplings between said corresponding capacitor electrodes and inner conductors.

12. A dielectric filter as in claim 10, wherein said outer surface of said dielectric block further comprises opposed first and second side surfaces which extend between said first and second end surfaces, and opposed top and bottom surfaces which extend between said first and second end surfaces and which also extend between said first and second side surfaces, two of said three resonator holes being located adjacent to said first and second side surfaces, respectively.

13. A dielectric filter as in claim 7, further comprising a pair of input/output electrodes disposed at least on said second end surface of said dielectric block, each of said input/output electrodes being electrically connected to a corresponding one of said capacitor electrodes.

14. A dielectric filter as in claim 13, wherein said dielectric block further comprises opposed first and second side surfaces which extend between said end surfaces, and opposed top and bottom surfaces which extend between said first and second end surfaces and which also extend between said first and second side surfaces, and each of said input/output electrodes extends from said corresponding capacitor electrode across a portion of said second end surface and a portion of said bottom surface.

15. A dielectric filter as in claim 13, wherein said respective capacitor electrodes are capacitively coupled in series between said input/output electrodes by said respective second capacitance formed between each adjacent pair of capacitor electrodes, and said first capacitances define respective capacitive couplings between said corresponding capacitor electrodes and inner conductors.

16. A method of manufacturing a dielectric band-elimination filter comprising the steps of:

forming a dielectric block having an outer surface including opposed first and second end surfaces, and a plurality of resonator holes which extend in a direction defined between said first and second end surfaces;

forming a respective opening at each of said resonator holes at a first end thereof which opens at said first end surface of said dielectric block, and each said hole having a respective second end disposed within said dielectric block;

forming a respective inner conductor on an inner surface of each of said resonator holes;

forming a plurality of capacitor electrodes respectively corresponding to said resonator holes, said capacitor electrodes being disposed on said second end surface, each capacitor electrode being spaced from said second end of the corresponding resonator hole so as to define a respective first capacitance with the corresponding inner conductor of said hole;

said respective capacitor electrodes further being spaced from each other along said second end surface so as to define between each adjacent pair of capacitor electrodes a corresponding second capacitance; and forming an outer conductor on said outer surface of said dielectric block except for a portion of said outer surface surrounding said capacitor electrodes and input/output electrodes, said outer conductor being conductively connected at said first end surface to each of said inner conductors;

wherein said inner conductors and said capacitor electrodes are configured and disposed so that said dielectric block inner and outer conductors, and capacitor electrodes provide a band-elimination filter.

17. A method as in claim 16, wherein two said resonator holes are formed, and two said respective capacitor electrodes are formed, said two respective capacitor electrodes defining therebetween one said corresponding second capacitance.

18. A method as in claim 17, further comprising the step of forming a pair of input/output electrodes at least on said second end surface of said dielectric block, said pair of input/output electrodes being electrically connected to corresponding ones of said capacitor electrodes; wherein said two capacitor electrodes are capacitively coupled in series between said input/output electrodes by said respective second capacitances formed between each adjacent pair of capacitor electrodes, and said respective first capacitances form corresponding capacitive couplings between said respective capacitor electrodes and said corresponding inner conductors.

19. A method as in claim 16, wherein three said resonator holes are formed, and three said respective capacitor electrodes are formed, each adjacent pair of said respective capacitor electrodes defining therebetween a corresponding said second capacitance.

20. A method as in claim 19, further comprising the step of forming a pair of input/output electrodes at least on said second end surface of said dielectric block, said pair of input/output electrodes being electrically connected to corresponding ones of said capacitor electrodes; wherein said three capacitor electrodes are capacitively coupled in series between said input/output electrodes by said second capacitances formed between each adjacent pair of capacitor electrodes, and said respective first capacitances form corresponding capacitive couplings between said respective capacitor electrodes and said corresponding inner conductors.

21. A method as in claim 19, wherein said step of forming the dielectric block further comprises the steps of:

forming opposed first and second side surfaces which extend between said end surfaces, and opposed top and bottom surfaces which extend between said first and second end surfaces and which also extend between said first and second side surfaces, and locating two of said three resonator holes adjacent to said first and second side surfaces, respectively.

22. A method as in claim 16, further comprising the step of forming a pair of input/output electrodes at least on said second end surface of said dielectric block, said pair of input/output electrodes being electrically connected to corresponding ones of said capacitor electrodes.

23. A method as in claim 22, wherein said step of forming the dielectric block further comprises the steps of forming opposed first and second side surfaces which extend between said end surfaces, and opposed top and bottom surfaces which extend between said first and second end surfaces and which also extend between said first and second side surfaces, and forming each of said input/output electrodes respectively to extend from said corresponding capacitor electrode across a portion of said second end surface and a portion of said bottom surface.

24. A method as in claim 22, further comprising the step of locating said capacitor electrodes so that said capacitor electrodes are capacitively coupled in series between said input/output electrodes by said respective second capacitance formed between each adjacent pair of capacitor electrodes, and so that said respective first capacitances form corresponding capacitive couplings between said respective capacitor electrodes and said corresponding inner conductors.

25. A method of manufacturing a dielectric filter comprising the steps of:

forming a dielectric block having an outer surface, including opposed first and second end surfaces, and a plurality of resonator holes which extend in a direction defined between said first and second end surfaces;

forming a respective opening at each of said resonator holes at a first end thereof which opens at said first end surface of said dielectric block, and each said hole having a respective, second end disposed within said dielectric block;

forming a respective inner conductor on an inner surface of each of said resonator holes;

forming a plurality of capacitor electrodes respectively corresponding to said resonator holes, said capacitor electrodes being disposed on said second end surface, each capacitor electrode being spaced from said second end of the corresponding resonator hole so as to define a respective first capacitance with the corresponding inner conductor of said hole;

said respective capacitor electrodes further being spaced from each other along said second end surface so as to define between each adjacent pair of capacitor electrodes a corresponding second capacitance;

forming a pair of input/output electrodes at least on said second end surface of said dielectric block, said pair of input/output electrodes being electrically connected to corresponding ones of said capacitor electrodes; and forming an outer conductor on said outer surface of said dielectric block except for a portion of said outer surface surrounding said capacitor electrodes and input/output electrodes;

further comprising the step of adjusting a spacing between a respective capacitor electrode and a corresponding inner conductor so as to obtain a predetermined capacitance therebetween.

26. A method of manufacturing a dielectric filter comprising the steps of:

forming a dielectric block having an outer surface including opposed first and second end surfaces, and a plurality of resonator holes which extend in a direction defined between said first and second end surfaces;

forming a respective opening at each of said resonator holes at a first end thereof which opens at said first end surface of said dielectric block, and each said hole having a respective second end disposed within said dielectric block;

forming a respective inner conductor on an inner surface of each of said resonator holes;

forming a plurality of capacitor electrodes respectively corresponding to said resonator holes, said capacitor electrodes being disposed on said second end surface, each capacitor electrode being spaced from said second end of the corresponding resonator hole so as to define a respective first capacitance with the corresponding inner conductor of said hole;

said respective capacitor electrodes further being spaced from each other along said second end surface so as to define between each adjacent pair of capacitor electrodes a corresponding second capacitance;

forming a pair of input/output electrodes at least on said second end surface of said dielectric block, said pair of input/output electrodes being electrically connected to corresponding ones of said capacitor electrodes; and forming an outer conductor on said outer surface of said dielectric block except for a portion of said outer surface surrounding said capacitor electrodes and input/output electrodes;

further comprising the step of adjusting a size of a respective capacitor electrode so as to obtain a predetermined capacitance between said respective capacitor electrode and a corresponding inner conductor.

* * * * *